US010648649B2

(12) United States Patent
Harris et al.

(10) Patent No.: US 10,648,649 B2
(45) Date of Patent: May 12, 2020

(54) METHODS AND SYSTEMS FOR SELECTING A LIGHT FIXTURE

(71) Applicant: Hubbell Incorporated, Shelton, CT (US)

(72) Inventors: Joseph Harris, Anderson, SC (US); Palmer Primm, Greenville, SC (US)

(73) Assignee: Hubbell Incorporated, Shelton, CT (US)

( * ) Notice: Subject to any disclaimer, the term of this patent is extended or adjusted under 35 U.S.C. 154(b) by 15 days.

(21) Appl. No.: 15/915,831

(22) Filed: Mar. 8, 2018

(65) Prior Publication Data

US 2018/0259163 A1 Sep. 13, 2018

Related U.S. Application Data

(60) Provisional application No. 62/468,722, filed on Mar. 8, 2017.

(51) Int. Cl.

| | |
|---|---|
| ***F21V 17/00*** | (2006.01) |
| ***F21V 21/02*** | (2006.01) |
| ***F21V 5/00*** | (2018.01) |
| ***F21V 5/04*** | (2006.01) |
| ***F21V 3/02*** | (2006.01) |
| ***F21V 17/14*** | (2006.01) |
| ***F21V 17/08*** | (2006.01) |
| *F21Y 115/10* | (2016.01) |

(52) U.S. Cl.

CPC ..... *F21V 17/002* (2013.01); *F21V 3/02* (2013.01); *F21V 5/008* (2013.01); *F21V 5/04* (2013.01); *F21V 17/14* (2013.01); *F21V 21/02* (2013.01); *F21V 17/08* (2013.01); *F21Y 2115/10* (2016.08)

(58) Field of Classification Search

CPC ..... F21V 17/002–20; F21V 21/02–049; F21V 1/143

See application file for complete search history.

(56) References Cited

U.S. PATENT DOCUMENTS

| | | | | |
|---|---|---|---|---|
| 8,425,082 | B2 * | 4/2013 | Wang | F21S 8/04 362/249.02 |
| 8,678,632 | B2 * | 3/2014 | Gallai | F21V 19/001 362/548 |
| 8,770,806 | B2 * | 7/2014 | Koo | F21V 13/02 362/374 |
| 9,574,758 | B2 * | 2/2017 | Ahn | F21S 8/036 |
| 10,190,754 | B2 * | 1/2019 | Harpenau | F21V 21/04 |
| 2013/0033872 | A1 * | 2/2013 | Randolph | F21K 9/00 362/294 |

(Continued)

*Primary Examiner* — Mariceli Santiago

(74) *Attorney, Agent, or Firm* — Michael Best & Friedrich, LLP

(57) ABSTRACT

A light fixture assembly includes a base including a recessed surface, an outer wall, and a base connecting member extending from the outer wall. A light emitter is connectable to the recessed surface of the base. An inner lens is connectable to the base over the light emitter. An outer lens is configured to be selectively connected to the base. The outer lens includes a lens connecting member configured to connect to the base connecting member. An accessory mount is configured to be selectively connected to the base. The accessory mount includes an accessory mount connecting member configured to connect to the base connecting member.

20 Claims, 11 Drawing Sheets

(56) References Cited

U.S. PATENT DOCUMENTS

| | | | | |
|---|---|---|---|---|
| 2013/0272019 | A1* | 10/2013 | Engstrom | F21V 21/03 362/581 |
| 2014/0084787 | A1* | 3/2014 | Tsai | F21K 9/65 315/50 |
| 2014/0268791 | A1* | 9/2014 | Randolph | F21V 3/02 362/277 |
| 2016/0356462 | A1* | 12/2016 | O'Brien | F21V 21/02 |
| 2019/0113193 | A1* | 4/2019 | Serak | G02B 6/0031 |

* cited by examiner

METHODS AND SYSTEMS FOR SELECTING A LIGHT FIXTURE

RELATED APPLICATION(S)

This application is based on U.S. Provisional Application Ser. No. 62/468,722, filed Mar. 8, 2017, the disclosure of which is incorporated herein by reference in its entirety and to which priority is claimed.

FIELD

Various exemplary embodiments relate to indoor light fixtures and methods of selecting and creating different light fixtures from a number of components.

BACKGROUND

Light fixtures are a key functional and aesthetic component of a home. Some factors to consider when selecting home light fixtures are the size of the light fixture, the appearance of the light fixture, the light output, and the color temperature. For example, in a dining room with a high ceiling, a larger, more decorative light fixture might be desired with a lower light output and warmer color temperature. In a bathroom with a low ceiling, a smaller, more functional light fixture with a higher light output and cooler color temperature may be desired. Light fixtures can also have many different design elements incorporated into their components.

In order to offer a broad range of light fixtures, retailers must either keep a large inventory of lights, or take customer's orders and produce light fixtures based on the customer's selection. Keeping a large inventory can be problematic for non-specialty stores or stores in locations like cities where having a large footprint can be overly expensive. Building light fixtures to order can result in increased lead-times and increased expenses due to shipping costs.

SUMMARY

According to an exemplary embodiment, a light fixture assembly includes a base including a recessed surface, an outer wall, and a base connecting member extending from the outer wall. A light emitter is connectable to the recessed surface of the base. An inner lens is connectable to the base over the light emitter. An outer lens is configured to be selectively connected to the base. The outer lens includes a lens connecting member configured to connect to the base connecting member. An accessory mount is configured to be selectively connected to the base. The accessory mount includes an accessory mount connecting member configured to connect to the base connecting member.

According to an exemplary embodiment, a set of connectable light fixture components includes a base having a recessed surface, an outer wall, and a base connecting member extending from the outer wall. A light emitter is connected to the recessed surface of the base. An inner lens is connected to the base over the light emitter. A series of outer lenses is configured to be individually and selectively connected to the base. Each of the outer lenses include a lens connecting member configured to connect to the base connecting member. An accessory mount is configured to be selectively connected to the base. The accessory mount includes an accessory mount connecting member configured to connect to the base connecting member.

Another exemplary embodiment includes a method of creating a light fixture assembly. A plurality of light output options are provided to a user and the user is allowed to select one of the light output options. A plurality of base member options are provided to the user and the user is allowed to select one of the base member options. The base members each include a recessed surface, an outer wall, and a base connecting member extending from the outer wall. A plurality of light conditioning member options are provided to the user and the user is allowed to optionally select one of the light conditioning member options. A plurality of accessory options are provided to the user and the user is allowed to select one of the accessory options. A light fixture is assembled based on the user's selection.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Various exemplary embodiments relate to components, methods, and systems for creating and selecting a final indoor lighting product by choosing a series of elements from different possible combinations.

Figure 1:
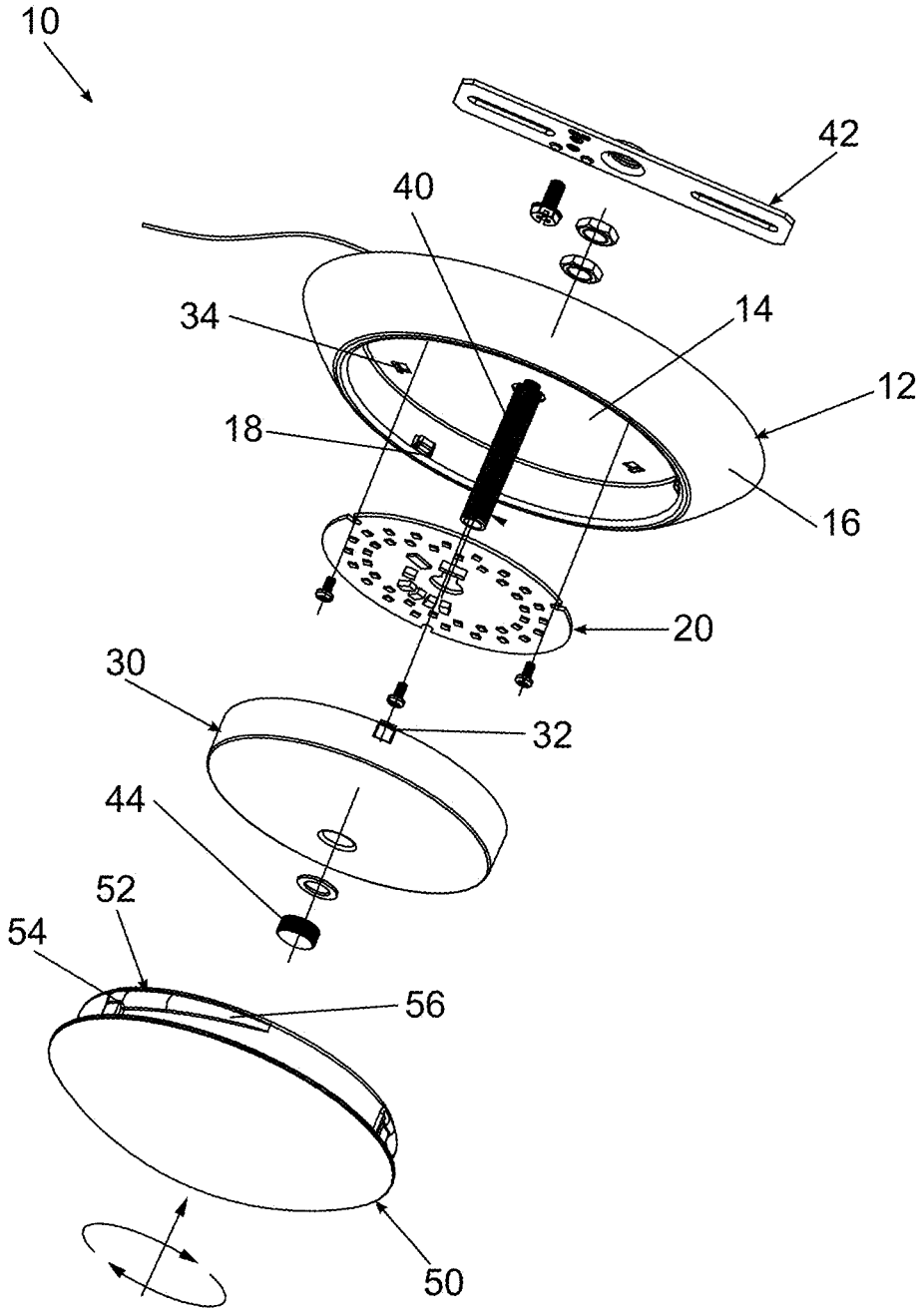
FIG. 1 is a perspective, exploded view of a light fixture assembly.

FIG. 1 shows an example associated with an interior light fixture 10. The light fixture 10 includes a base 12 that is connected to and positioned near a support, such as a ceiling. The base 12 includes a recessed surface 14 and an outer wall 16 extending from the recessed surface 14. The base 12 is shown as having a frusto-spherical or frusto-domed configuration, although other shapes can be used. One or more base connection members extend from the outer wall and are configured to connect additional components to the base 12. The base connection members are shown as protrusions 18 extending from the outer wall 16 toward a central region of the base 12.

A light emitter 20 is connected to the recessed surface 14 of the base 12. The light emitter 20 is shown as an LED light engine formed on a printed circuit board. The number of LEDs and the intensity of the LEDs can be adjusted to provide different light outputs. In certain circumstances, an inner lens 30 is connected to the base 12 and positioned over the light emitter 20. The inner lens 30 can provide light diffusion and/or coloration for the light emitter. Different inner lenses 30 can therefore be connected to the base 12 to alter the light output for a given light emitter 20. In the illustrated embodiment, the inner lens 30 is snap-fit to the base using cantilevered beams 32 that mate with slots or openings 34 in the recessed surface 14.

The base 12 includes an opening for receiving a mounting component. The mounting component can also connect or retain different components to the base 12, as well as connect the base 12 to a support. In the illustrated embodiment, the mounting component 12 includes a threaded nipple 40. The threaded nipple 40 is threadably connected to a mounting strap 42 which is attached to a support surface, such as a junction box positioned in the ceiling. The threaded nipple 40 can also be help in place relative to the mounting strap 42 using one or more nuts. The base 12, light emitter 20, and inner lens 30 can then be slidably connected to the threaded nipple 40 and secured using a threaded cap 44.

Figure 2:
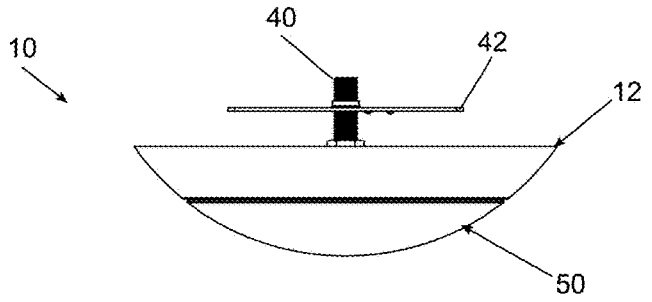
FIG. 2 is side view of another light fixture assembly.

In various exemplary embodiments, an outer lens can be connected to the base 12. FIGS. 1 and 2 show a dome outer lens 50 that includes one or more lens connection members. In the illustrated embodiment, the lens connection members include a ramped slot or groove 52 that can be secured to the projections 18 on the base 12 in a ramped, bayonet-type twist connection. The groove 52 includes a key opening 54 that initially receives the protrusions 18. An angled or ramped portion 56 extends from the key opening 54, decreasing in height to form an interference fit with the protrusion 18 as the outer lens 50 is rotated relative to the base 12.

Figure 3:
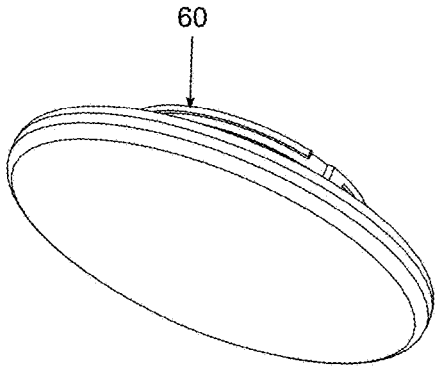
FIG. 3 is a perspective view of a light fixture lens.
Figure 4:
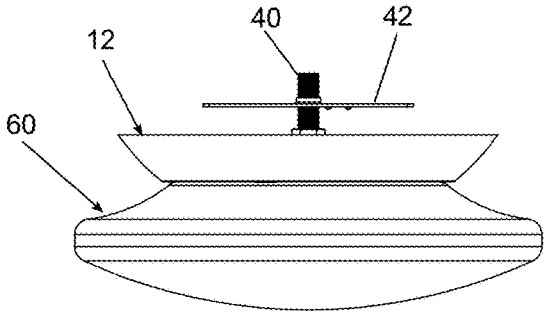
FIG. 4 is side view of a light fixture assembly with the lens of FIG. 3.
Figure 5:
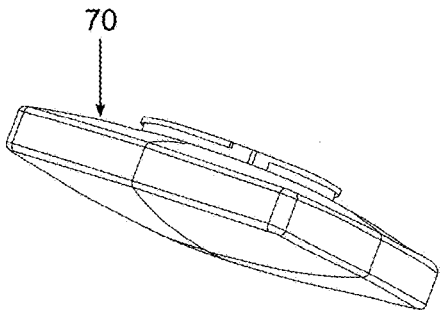
FIG. 5 is a perspective view of another light fixture lens.
Figure 6:
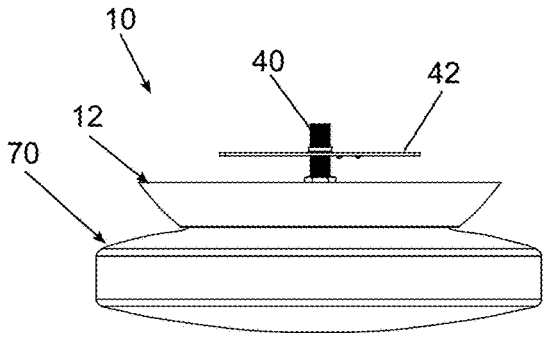
FIG. 6 is side view of a light fixture assembly with the lens of FIG. 5.
Figure 7:
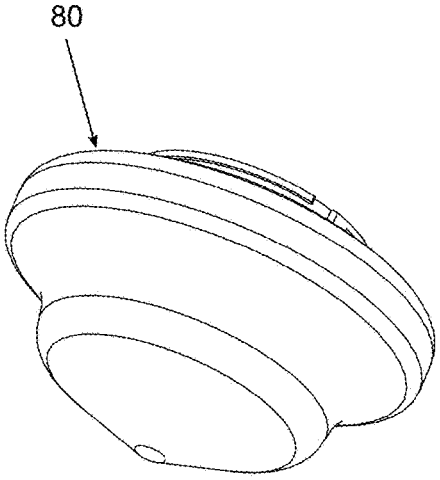
FIG. 7 is a perspective view of another light fixture lens.
Figure 8:
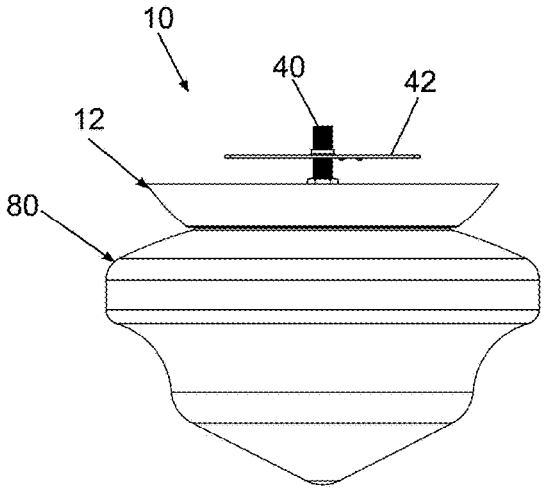
FIG. 8 is side view of a light fixture assembly with the lens of FIG. 7.
Figure 9:
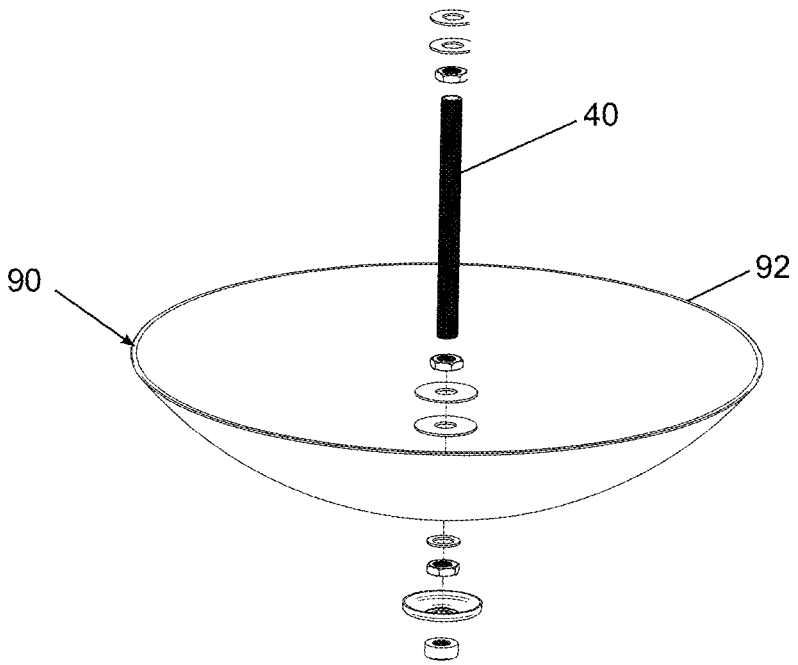
FIG. 9 is a perspective view of another light fixture lens assembly.

Different outer lenses can be connected to the base 12 to provide different appearances to the light fixture. FIGS. 3 and 4 show a round outer lens design 60 connected to the base 12. FIGS. 5 and 6 show a square outer lens design 70 connected to the base 12. FIGS. 7 and 8 show a school house outer lens design 80 connected to the base 12. FIG. 9 shows a semi-flush lens 90 that connects to the base 12 through the threaded nipple 40. The semi-flush lens 90 includes an upper edge 92 that lies substantially level with the bottom edge of the base 12. The semi-flush lens 90 can have different diameters, with the embodiment shown having a greater diameter than the base 12. Different designs, and different sizes of the designs shown in FIGS. 1-9, can also be used.

Figure 10:
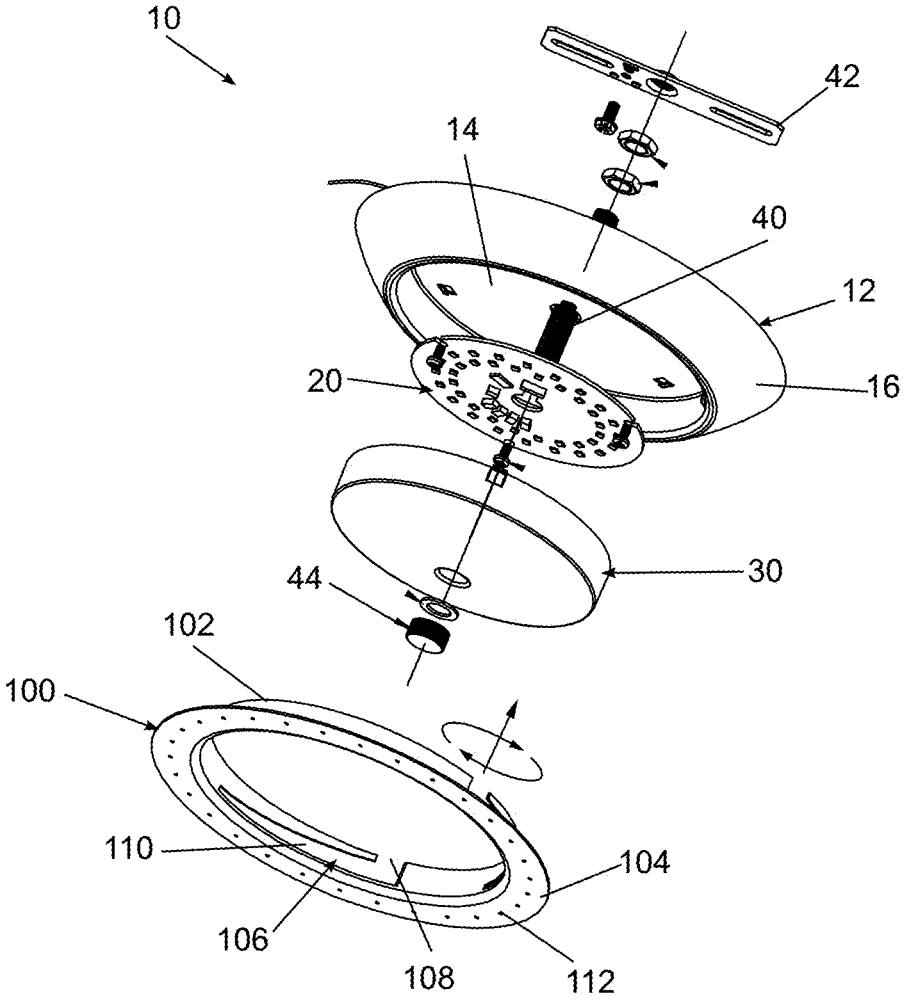
FIG. 10 is a perspective, exploded view of a light fixture assembly including an attachment ring.
Figure 11:
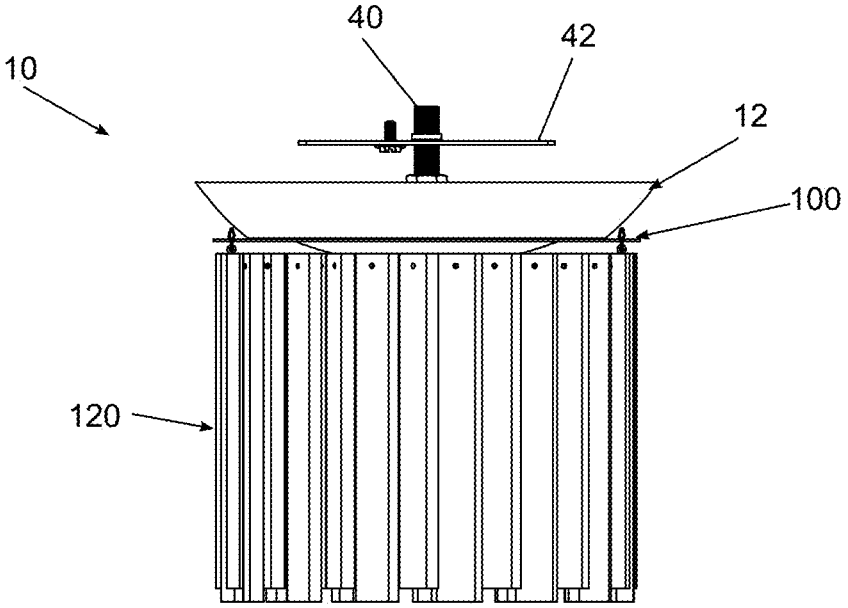
FIG. 11 is a side view of a light fixture assembly with hanging members connected to the attachment ring.

FIG. 10 shows an accessory mount that can be connected to the base 12 to provide different design options to the light fixture 10. In the exemplary embodiment, the accessory mount is an attachment ring 100 that is connected to the base 12 in a manner similar to the outer lenses described above. The attachment ring 100 is rotatably connected to the base 10, and additional components can be connected to the attachment ring 100 to alter the appearance of the light fixture 10.

The attachment ring 100 includes a side wall 102 and a flange 104 extending outwardly from a lower edge of the side wall 102. The side wall 102 includes a ring connection member to connect to the base connection member. The ring connection member includes a ramped slot or groove 106 that can be secured to the projections on the base in a ramped, bayonet-type twist connection. The slot 106 includes a key opening 108 that initially receives the protrusions. An angled or ramped portion no extends from the key opening 108, decreasing in height to form an interference fit with the protrusion 18 as the attachment ring 100 is rotated relative to the base 12.

The flange 104 includes a series of apertures 112 that receive one or more accessory components. The apertures 112 can be openings or through holes that are closed off to the outer edge of the flange, or they can be slots that are open to the outer edge of the ring, along components to be slidably attached to the attachment ring 100. The apertures 112 can include different sized portions, such as key-hole type slots. The size, shape, and number of apertures 112 can vary depending on the associated accessories to be attached. A single design attachment ring 100 can be provided to work with multiple accessories, or different attachment rings 100 can be used for different accessories.

FIG. 1*i* shows the attachment ring 100 connected to the base 12 and a set of hanging members 120 connected to the attachment ring 100. The hanging members 120 can be made from glass, acrylic, or other materials. The hanging members 120 can be transparent, reflective, semi-transparent, or include other optical properties to direct or diffuse light from the light emitter 20. In certain embodiments, the hanging members 120 may also be opaque.

Figure 12:
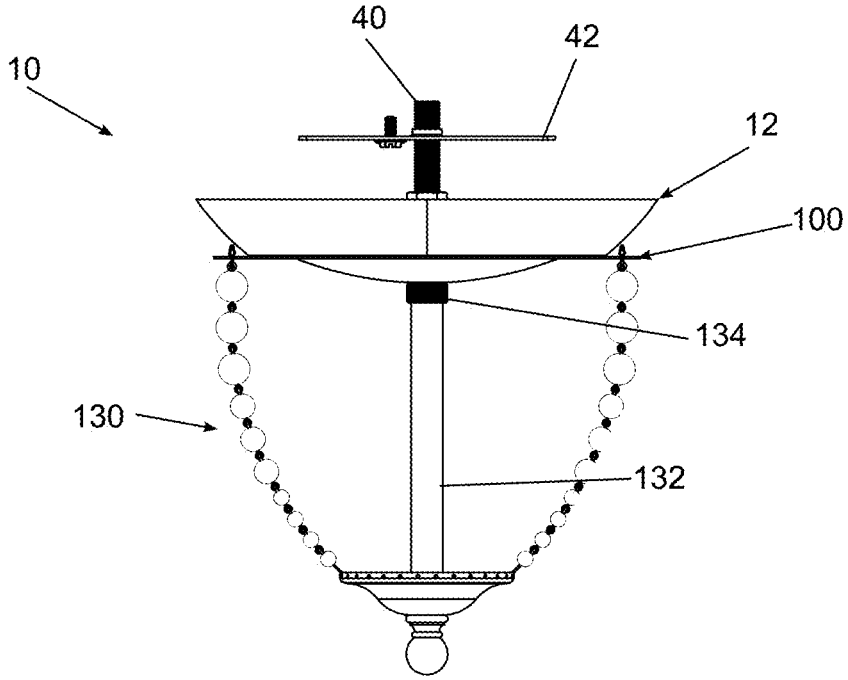
FIG. 12 is a side view of a light fixture assembly with bead members connected to the attachment ring.

FIG. 12 shows the attachment ring 100 connected to the base 12 and a set of beaded hanging members 130 connected to the attachment ring 100. This embodiment also utilizes an extension pipe 132 that is connected to the threaded nipple 40, for example by a threaded nut 134. The beads 130 can be made from glass, acrylic, or other materials. The beads 130 can be colored, transparent, reflective, semi-transparent, or include other optical properties to direct or diffuse light from the light emitter 20. In certain embodiments, the beads 130 may also be opaque.

Figure 13:
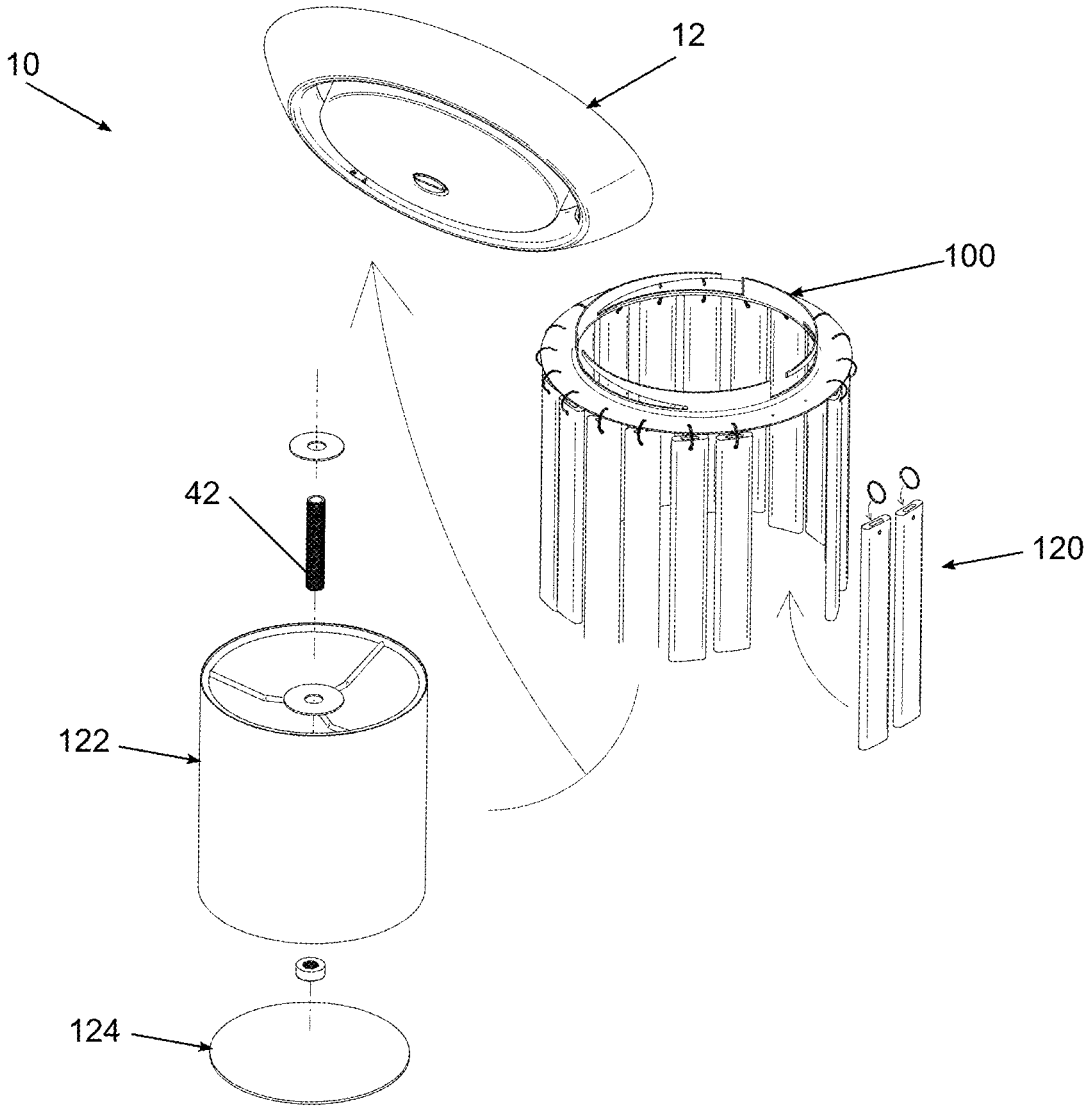
FIG. 13 is a perspective, exploded view of a light fixture assembly with hanging members connected to the attachment ring and a shade.

FIG. 13 shows an embodiment where the attachment ring 100 is used with the hanging members 120 and a shade 122. The hanging members 120 are connected to the attachment ring 100 and the shade 122 is positioned inside of the hanging members 120. A lens 124 is positioned beneath the shade 122.

Figure 14:
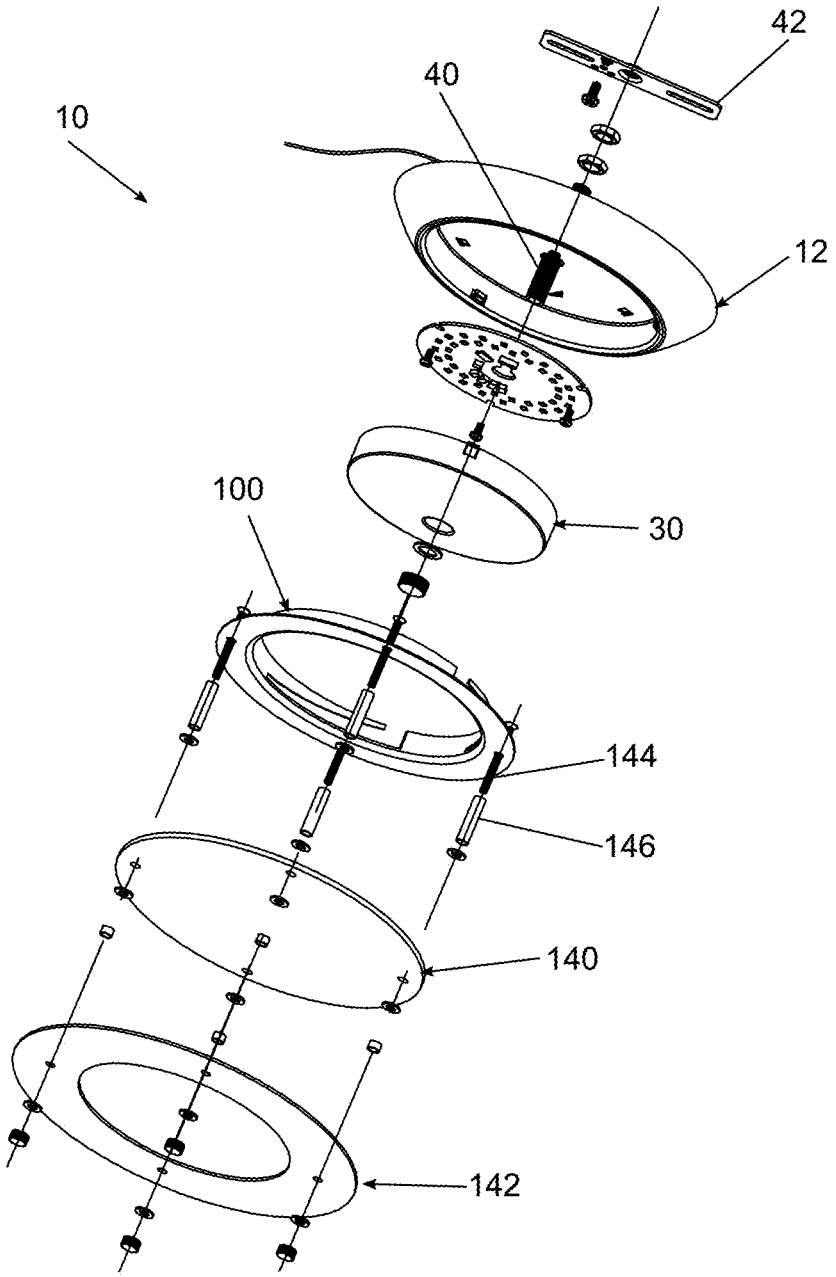
FIG. 14 is a perspective, exploded view of a light fixture assembly with an attachment ring and a floating ring.
Figure 15:
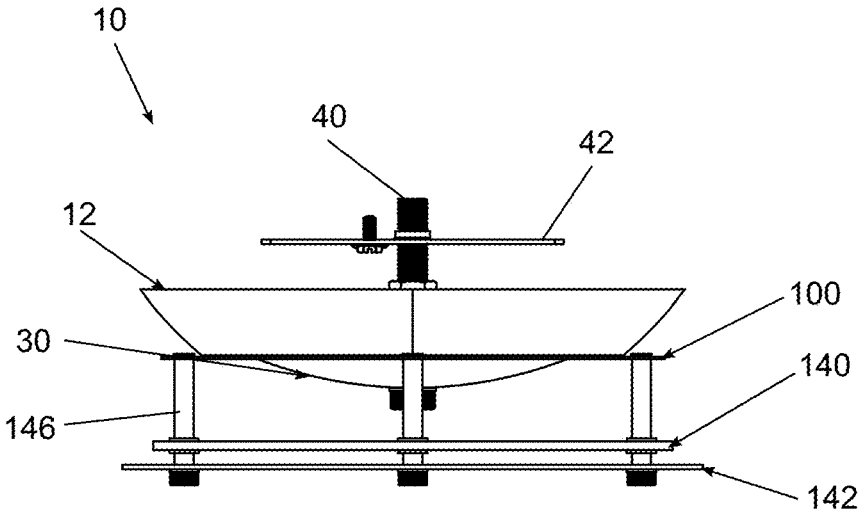
FIG. 15 is a side view of the light fixture of FIG. 14.

FIGS. 14 and 15 show the attachment ring 100 connected to the base 12 and an embodiment where an outer lens 140 and a floating ring 142 are connected to the attachment ring 100. The outer lens 140 and floating ring 142 are connected to the attachment ring 100 through fasteners 144 and offset from each other through posts 146.

Figure 16:
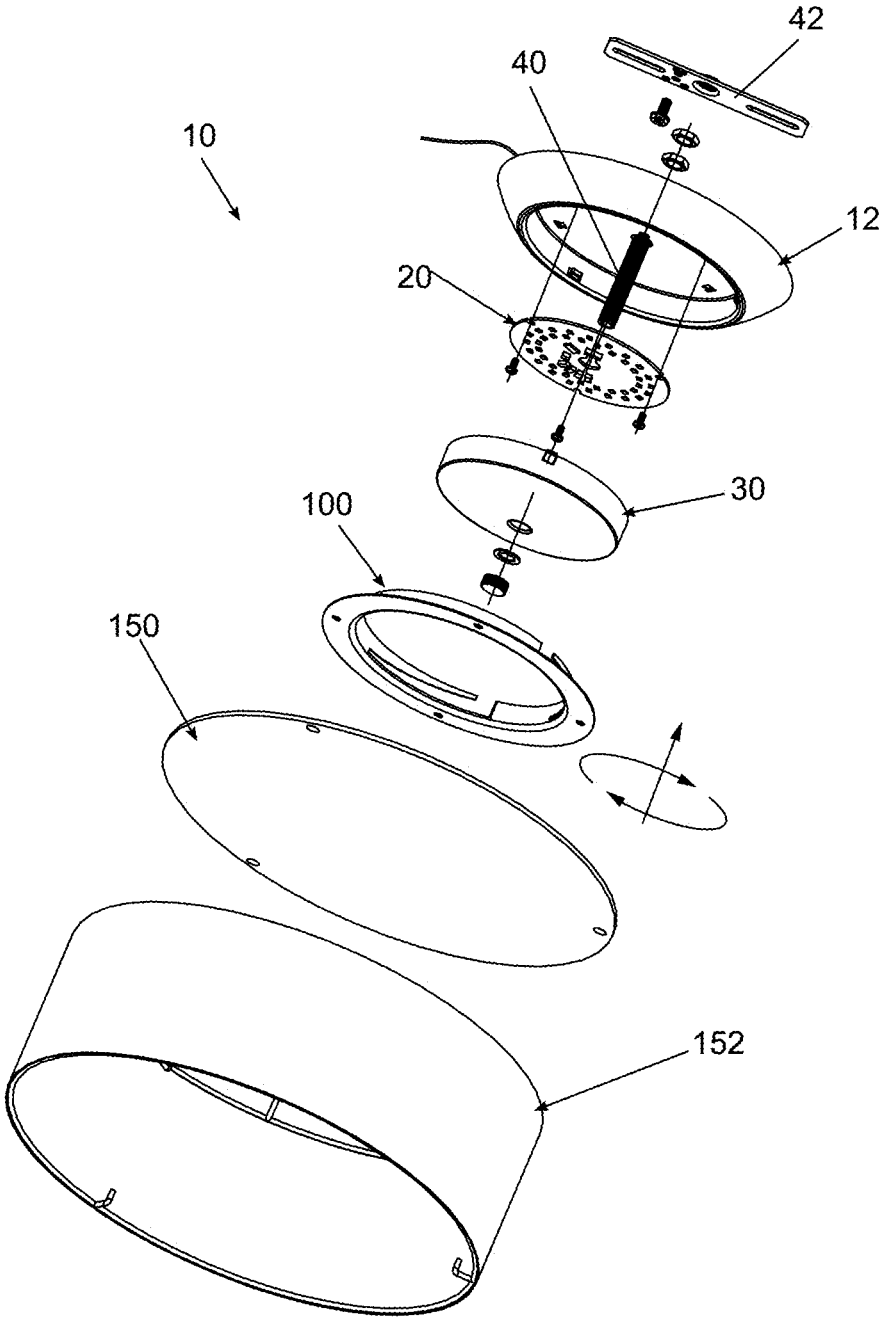
FIG. 16 is a perspective, exploded view of a light fixture assembly with an attachment ring and a shade.

FIG. 16 shows the attachment ring 100 connected to the base 12 and an embodiment where an outer lens 150 and a shade 152 are connected to the attachment ring 100. The outer lens 150 can be made from glass, acrylic, or other materials. The outer lens 150 can be colored, transparent, reflective, semi-transparent, or include other optical properties to direct or diffuse light from the light emitter 20.

Figure 17:
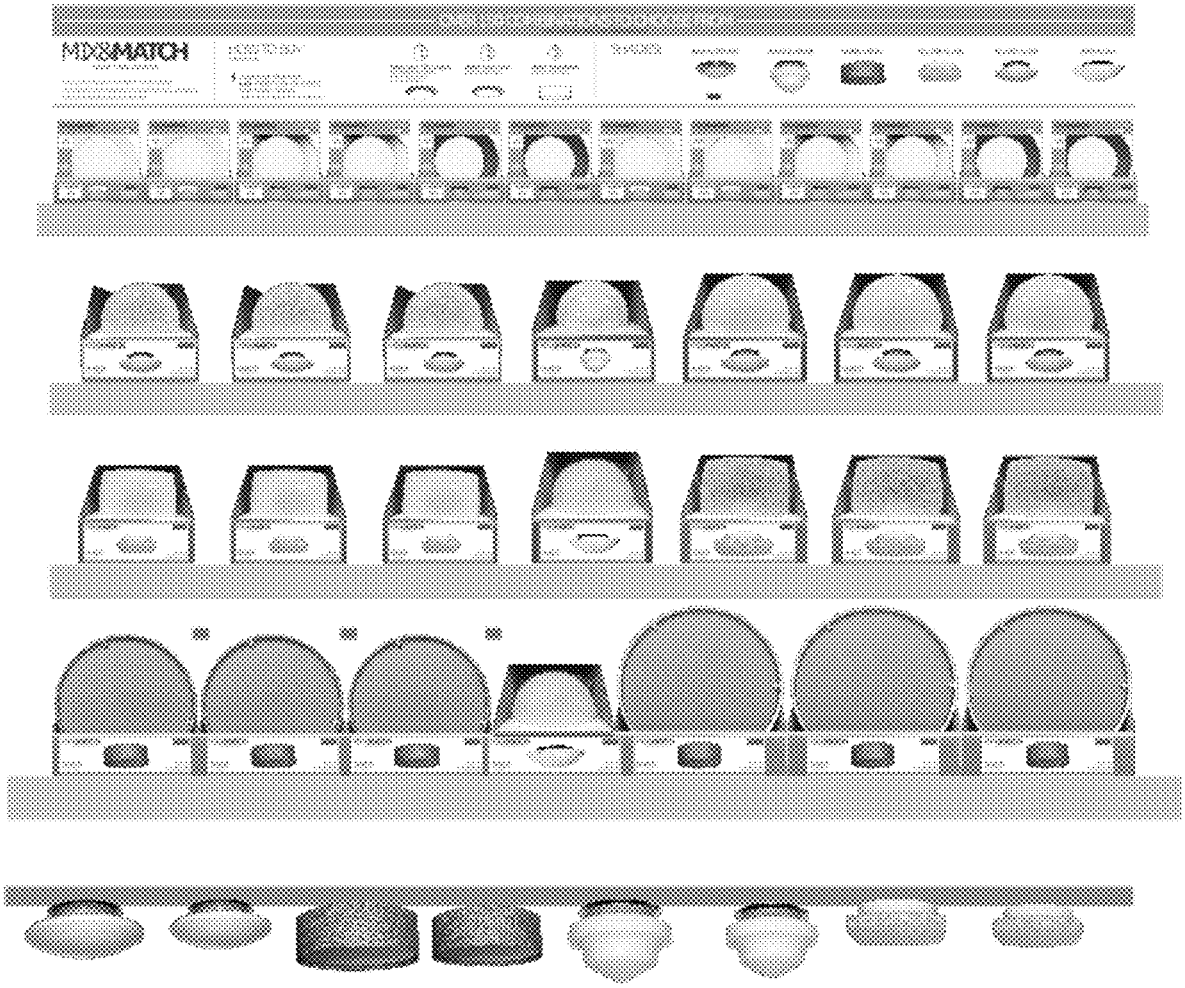
FIG. 17 is an exemplary embodiment of a light fixture shelf display.

As shown in FIG. 17, a user is provided with different sets of components that can be selected to customize the light fixture 10. One option is to choose a light output of the fixture. Factors that can be incorporated into the choice of light output can include any combination of color temperature, brightness, light distribution. Different light emitters 20 are used based on the user's selection.

Another option is to choose the finish or other options for the base 12. Factors that can be incorporated into the choice of base 12 can include any combination of size, shape, color, sheen, and material.

Another option is to choose one or more light conditioning members for the light fixture 10. The light conditioning member diffuses and/or directs the light emitted light. The light conditioning member can include an inner lens, an outer lens, a shade, or any combination thereof. Factors that can be incorporated into the choice of light conditioning member can include any combination of size, shape, color, material, opacity, light direction, and light diffusion.

The options can be provided to a user in any order, or in a specific order. For example the options can be provided using an in-store display or through an online or electronic display. The user selects one of each option and the selected components are provided and assembled to form a light fixture using the common mating components.

In various exemplary embodiments, the options are provided to a user and the selection is made through a user access device. The user access device can be a tablet, phone, desktop, laptop, kiosk, wearable computer, or other electronic device configured with a display to provide images of the product elements to the user and a user input device that allows the user to make selections. The user access device can operate locally, for example at a store or other point of sale, or over a network, such as the internet. The access device can allow the user to view the element selections individually and combined and can allow a user to view the element selections in different image backgrounds, including stock images and images provided by a user.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A light fixture assembly comprising:

a base including a recessed surface, an outer wall, and a base connecting member extending from the outer wall;

a light emitter connectable to the recessed surface of the base;

an inner lens connectable to the base over the light emitter;

an outer lens configured to be selectively connected to the base, the outer lens including a lens connecting member configured to connect to the base connecting member; and an accessory mount configured to be selectively connected to the base, the accessory mount including an accessory mount connecting member configured to connect to the base connecting member, wherein the lens connecting member includes a key opening and a ramped portion.

2. The light fixture assembly of claim 1, wherein the base connecting member includes a protrusion extending from the outer wall.

3. The light fixture assembly of claim 1, wherein the accessory mount includes a flange having a plurality of apertures.

4. The light fixture assembly of claim 1, wherein the accessory mount connecting member includes a key opening and a ramped portion.

5. The light fixture assembly of claim 1, further comprising a floating ring connectable to the accessory mount by a set of standoffs.

6. The light fixture assembly of claim 5, wherein a secondary lens is positioned between the floating ring and the accessory mount.

7. The light fixture of claim 1, wherein a set of hanging members are connectable to the accessory mount.

8. A set of connectable light fixture components comprising:

a base including a recessed surface, an outer wall, and a base connecting member extending from the outer wall;

a light emitter connected to the recessed surface of the base;

an inner lens connected to the base over the light emitter;

a series of outer lenses configured to be individually and selectively connected to the base, wherein each of the outer lenses include a lens connecting member configured to connect to the base connecting member; and an accessory mount configured to be selectively connected to the base, wherein the accessory mount includes an accessory mount connecting member configured to connect to the base connecting member, wherein at least one of the lens connecting members include a key opening and a ramped portion configured to engage the base connecting member.

9. The set of light fixture components of claim 8, wherein the base connecting member includes a first projection and a second projection extending from the outer wall.

10. The set of light fixture components of claim 8, wherein the accessory mount includes an attachment ring rotatably connected to the base.

11. The set of light fixture components of claim 10, wherein the attachment ring includes a side wall and a flange, and wherein the sidewall includes key opening and a ramp portion to connect to the base connecting member.

12. The set of light fixture components of claim 10, further comprising a set of hanging members configured to be connected to the flange.

13. The set of light fixture components of claim 10, further comprising a floating ring configured to be connected to the accessory mount.

14. The set of light fixture components of claim 13, wherein the floating ring is connected to the accessory mount by a set of offsets.

15. The set of light fixture components of claim 13, wherein a lens is positioned between the floating ring and the accessory mount.

16. A light fixture assembly comprising:

a base including a recessed surface, an outer wall, and a base connecting member extending from the outer wall;

a light emitter connectable to the recessed surface of the base;

an inner lens connectable to the base over the light emitter;

an outer lens configured to be selectively connected to the base, the outer lens including a lens connecting member configured to connect to the base connecting member; and an accessory mount configured to be selectively connected to the base, the accessory mount including an accessory mount connecting member configured to connect to the base connecting member, wherein the accessory mount connecting member includes a key opening and a ramped portion.

17. The light fixture of claim 16, wherein a set of hanging members are connectable to the accessory mount.

18. A set of connectable light fixture components comprising:

a base including a recessed surface, an outer wall, and a base connecting member extending from the outer wall;

a light emitter connected to the recessed surface of the base;

an inner lens connected to the base over the light emitter;

a series of outer lenses configured to be individually and selectively connected to the base, wherein each of the outer lenses include a lens connecting member configured to connect to the base connecting member; and an accessory mount configured to be selectively connected to the base, wherein the accessory mount includes an accessory mount connecting member configured to connect to the base connecting member, wherein the base connecting member includes a first projection and a second projection extending from the outer wall.

19. The set of light fixture components of claim 18, further comprising a set of hanging members configured to be connected to the flange.

20. The set of light fixture components of claim 18, further comprising a floating ring configured to be connected to the accessory mount.

* * * * *